United States Patent [19]

Jacobsson

[11] Patent Number: 5,050,405

[45] Date of Patent: Sep. 24, 1991

[54] METHOD FOR POSITIVELY FEEDING AN ELASTIC YARN, AND CIRCULAR KNITTING MACHINE

[75] Inventor: Kurt A. G. Jacobsson, Ulricehamn, Sweden

[73] Assignee: IRO AB, Ulricehamn, Sweden

[21] Appl. No.: 445,620

[22] PCT Filed: May 5, 1988

[86] PCT No.: PCT/EP88/00384

§ 371 Date: Jan. 4, 1990

§ 102(e) Date: Jan. 4, 1990

[87] PCT Pub. No.: WO88/08893

PCT Pub. Date: Nov. 17, 1988

[30] Foreign Application Priority Data

May 5, 1987 [SE] Sweden ..... 8701876

[51] Int. Cl.[5] ..... D04B 15/50

[52] U.S. Cl. ..... 66/132 R; 242/47.01

[58] Field of Search ..... 66/135 R, 132 R; 242/47.01

[56] References Cited

U.S. PATENT DOCUMENTS

| | | | |
|---|---|---|---|
| 3,327,499 | 6/1967 | Schmidt et al. | 66/132 R |
| 3,745,793 | 7/1973 | Heinig et al. | 66/132 R X |
| 3,780,541 | 12/1973 | Haynes | 66/132 R X |
| 4,586,543 | 5/1986 | Volland et al. | 242/47.01 X |
| 4,702,285 | 10/1987 | Sugita | 242/47.01 X |
| 4,716,943 | 1/1988 | Yoshida et al. | 242/47.01 X |
| 4,739,942 | 4/1988 | Maenaka | 242/47.01 |
| 4,756,344 | 7/1988 | Takegawa | 242/47.01 X |
| 4,768,565 | 9/1988 | Tholander | 242/47.01 X |
| 4,850,400 | 7/1989 | Gorris | 242/47.01 X |

FOREIGN PATENT DOCUMENTS

| | | | |
|---|---|---|---|
| 2651857 | 5/1978 | Fed. Rep. of Germany | 242/47.01 |

*Primary Examiner*—W. C. Reynolds
*Assistant Examiner*—John J. Calvert
*Attorney, Agent, or Firm*—Flynn, Thiel, Boutell & Tanis

[57] ABSTRACT

In a method for positively feeding an elastic yarn to the knitting system of a circular knitting machine having a yarn feeder apparatus controlled by an electronic control unit, the apparatus of a take-out signal (A) initiates the count of a preselected number of position signals (p) before generating a stop signal (S), or otherwise the take-out signal (A) is disregarded for a preselected space of time at the end of which the stop signal (S) is generated, the number of position signals (p) or the space of time, respectively, being selected in accordance with the yarn quality and/or the distance between the yarn feeder apparatus and the knitting system. In this manner the yarn feeding operation is continued for relaxing the elastic yarn. The electronic control unit (3) of the yarn feeder apparatus (2) in the circular knitting machine (1) includes a delay circuit (19) for controlling the generation of the stop signal (S).

13 Claims, 2 Drawing Sheets

METHOD FOR POSITIVELY FEEDING AN ELASTIC YARN, AND CIRCULAR KNITTING MACHINE

FIELD OF THE INVENTION

The present invention relates to a method of positively feeding elastic yarn to a knitting machine and to a circular knitting machine.

BACKGROUND OF THE INVENTION

In a method for positively feeding an elastic yarn to the knitting system of a circular knitting machine as known from PCT/EP86/00305, the start and stop signals for the control unit are derived from the movements of the yarn guide for the lead-in and take-out, respectively, of the elastic yarn. On appearance of the lead-in signal, the control unit starts the drive motor of the yarn feeder apparatus at a predetermined speed. The speed is modulated within a predetermined range in response to the successively generated position signals of the circular knitting machine to thereby achieve an accurately synchronized positive yarn feed to the knitting system, taking into account the operating stroke of the needles. Independent of the speed control of the drive motor, the appearance of the take-out signal causes the control unit to generate a stop signal for stopping the drive motor, so that the positive yarn feed terminates with the take-out of the yarn. During the knitting operation, the yarn between the yarn feeding apparatus and the knitting system may be under considerable tension, because the tension of the yarn is still further increased from the take-out instant until the yarn is cut off, due to the drive motor having been stopped, it is extremely difficult to retain the cut-off yarn in the customary yarn clamps (mechanical and/or vacuum-operated). This is due to the tension of the yarn and its compressibility which cause the yarn to slip from the yarn clamp, so that it is no longer available for the next lead-in operation.

Known from DE-OS 19 00 722, is a method for positively feeding an elastic yarn to the knitting system of a circular knitting machine. The yarn is temporarily fed at an increased speed after it has been taken out and before it is cut off, to thereby substantially release the tension of the yarn, so that it is safely retained by the yarn clamp. In this case, however, the operating principle of the purely mechanical yarn feeding apparatus is mechanically derived from the operation of the circular knitting machine, resulting in several disadvantages. The yarn feeder apparatus is only stopped by releasing a clutch after the yarn has been cut off. While the accelerated yarn feeding operation has been initiated at the take-out instant, the accelerated yarn feeding operation is not dictated by the characteristics of the yarn, i.e. its elasticity and smoothness, and the length of the yarn between the yarn feeder apparatus and the knitting system. Feeding is dictated exclusively by the interval between the take-out operation and an instant after the yarn has been cut off, and by the operating speed of the circular knitting machine. The actual tension of the yarn to be relaxed has thus no immediate influence. Although this known method at least partially solves the problems concerning the clamping of the elastic yarn, it is practically impossible to adjust the surplus yarn feed relative to the characteristics of the yarn and to its length between the yarn feeder apparatus and the knitting system. This method is also immediately dependent on a mechanical drive transmission between the knitting machine and the yarn feeder apparatus, which is no longer practicable in the case of a circular knitting machine with an electronically controlled yarn feeder apparatus. The mechanical principle employed in this method, namely, to stop the yarn feeder apparatus only after the yarn has been cut off, and to continue the drive transmission up to this instant, even at an increased yarn feeding speed, is totally unsuitable. This is particularly true when knitting machines are refitted or equipped with electronically controlled yarn feeder devices. The control unit has to perform control functions in response to the take-out signal, and is thus dependant on the timely apprearance of the take-out signal. It is an object of the present invention to provide a method of the type defined in the introduction, which is capable in a simple manner and without any fundamental modifications of the positive yarn feeding process under electronic control of ensuring that the elastic yarn is reliably clamped after having been taken out, independent of its characteristics and of its length between the yarn feeder apparatus and the knitting system. It is also an object to provide a circular knitting machine capable of reliably avoiding the occurrence of knitting faults due to escaping yarn ends, particularly when equipped with an electronically controlled yarn feeder apparatus. In all of its embodiments, the invention is intended to comply with the basic requirement that, after having been taken out, the elastic yarn shall not unacceptably sag on being led in again, and that between the take-out and lead-in operations the yarn is relaxed to the degree necessary for preventing it from being pulled out of the yarn clamp.

These objects are attained according to the invention by the characterizing features discussed below.

The control unit is capable of performing the usual control functions on appearance of the take-out signal. The drive motor of the yarn feeder apparatus is not yet stopped at this instant, however, because the control unit is prevented from generating the stop signal for the drive motor in response to the take-out signal until a predetermined number of position signals of the circular knitting machine has been received, or until a predetermined interval has expired. During this phase of the method the yarn continues to be positively fed at a rate dictated by the characteristics of the yarn and/or by the length of yarn between the yarn feeder apparatus and the knitting system. The control unit operates to stop the drive motor only after the predetermined number of position signals has been received or after the predetermined interval has expired, respectively. In this manner it is ensured that the yarn has been sufficiently relaxed, depending on its quality and the distance between the yarn feeder apparatus and the knitting system, so that it can be properly clamped after having been cut off. The surplus yarn feeding operation may in this case be continued beyond the instant at which the yarn is cut off and clamped to thereby reliably release its tension. When making use of the position signals, the surplus yarn feeding operation is independent of the operating speed of the circular knitting machine, because the predetermined number of position signals of the knitting machine is solely dependent on the displacement of the knitting cylinder relative to the knitting system. Sufficient relaxation of the yarn may be likewise achieved by properly selecting the interval to expire prior to the generation of the stop signal. The method is suitably applicable to any circular knitting machine equipped or refitted with electronically controlled yarn feeder devices.

Since the control of the drive motor of the yarn feeder apparatus is mechanically independent of the operation of the circular knitting machine, the method permits the surplus yarn length fed to be accurately adjusted to the yarn characteristics and/or to the respective knitting machine, with particular consideration as to whether the yarn is an extremely elastic, naked cord (rubber or lycra) or a less elastic textile-covered thread. The construction of the positive yarn feeder apparatus is not of importance i.e. the method is successfully applicable both to the positive yarn feeder devices in which a yarn supply is unwound by a roller resting on the yarn supply or by means of squeeze rollers, and to yarn feeder devices in which a yarn supply consisting of only a few yarn windings is formed on a drum rotated by the drive motor. The operation of the circular knitting machine does not have to be modified, so that the method is particularly suitable for refitted circular knitting machines or such machines intended to be refitted.

In a suitable embodiment of the method according to the invention, the predetermined interval is represented by signals of a timing signal sequence dependant on the characteristics of the elastic yarn and/or the distance between the yarn feeder apparatus and the knitting system. It is similarly also possible, however, to generate a single signal denoting the end of the interval after the take-out signal for causing the stop signal to be generated.

According to another important variation of the method, the operating speed of the drive motor may be increased or decreased relative to its operating speed prior to the appearance of the take-out signal, with the motor operating at this increased or decreased speed until generation of the stop signal. The electronic control unit is particularly well suited for this purpose, particularly when it is equipped with a programmable memory or microprocessor permitting it to control the drive motor independent of the operation of the circular knitting machine during this phase. The surplus yarn feeding operation is then carried out at a higher speed than normal for a rapid yarn relaxation or at a lower speed than normal for delayed yarn relaxation. The accelerated surplus feeding operation may already be terminated before the yarn is cut off. In the case of delayed surplus feeding operation, the relaxation period continues after the yarn has been cut off.

A circular knitting machine according to the present invention offers the advantage of highly reliable operation when processing elastic yarns, independent of the characteristics of the yarn being processed and of the distance between the yarn feeder apparatus and the knitting system. The delay circuit in the connection to the drive motor ensures that the drive motor continues to operate for the surplus yarn feeding operation after the take-out signal has been generated, until the yarn extending to the knitting system has been relaxed and can therefore be safely clamped. Most of the components employed are required for the operation of the yarn feeder apparatus in any case. The adaptation of the yarn feeder apparatus to the circular knitting machine (signal generators for position, take-out and lead-in signals) is very simple, so that already existing circular knitting machines may be readily re-equipped. The delay circuit can be integrated in the drive and control system of the yarn feeder apparatus without affecting the conventional control functions.

The delay circuit is suitably provided with a driver circuit for the take-out signal or stop signal, respectively, which is timed by the position signals of the circular knitting machine. The driver circuit delays the stop signal for the drive motor by a predetermined number of position signals to thereby ensure that the yarn extending to the knitting system is properly relaxed and can thus be safely clamped when the drive system of the yarn feeder apparatus is finally stopped.

For the universal adaptation of the circular knitting machine to any operating conditions it is advantageous to provide the delay circuit with selector means for the number of position signals to be counted or for the length of the interval after generation of the take-out signal. The selector means permits the operation to be adjusted to the characteristics of the yarn employed and/or to the distance between the feeder apparatus and the knitting system and/or to the yarn tension required for normal operation and intended to be relaxed, without affecting the circular knitting machine in any manner.

It may finally be advantageous to adjust the operating speed of the drive motor to a value deviating from the operating speed prior to the appearance of the take-out signal on activation of the delay circuit. With the provision of this adjustment it is possible to pre-select the speed of the yarn surplus feeding operation for relaxing the length of yarn between the yarn feeder apparatus and the knitting system. The yarn may thus already be relaxed before being received by the yarn clamp, or may alternatively be fully relaxed only after having been clamped under a certain tension, which may be helpful for the clamping operation, so as to be subsequently prevented from being pulled out of the clamp.

BRIEF DESCRIPTION OF THE DRAWINGS

The subject matter of the invention shall now be described with reference to the drawings, wherein.

DETAILED DESCRIPTION

Figure 1:
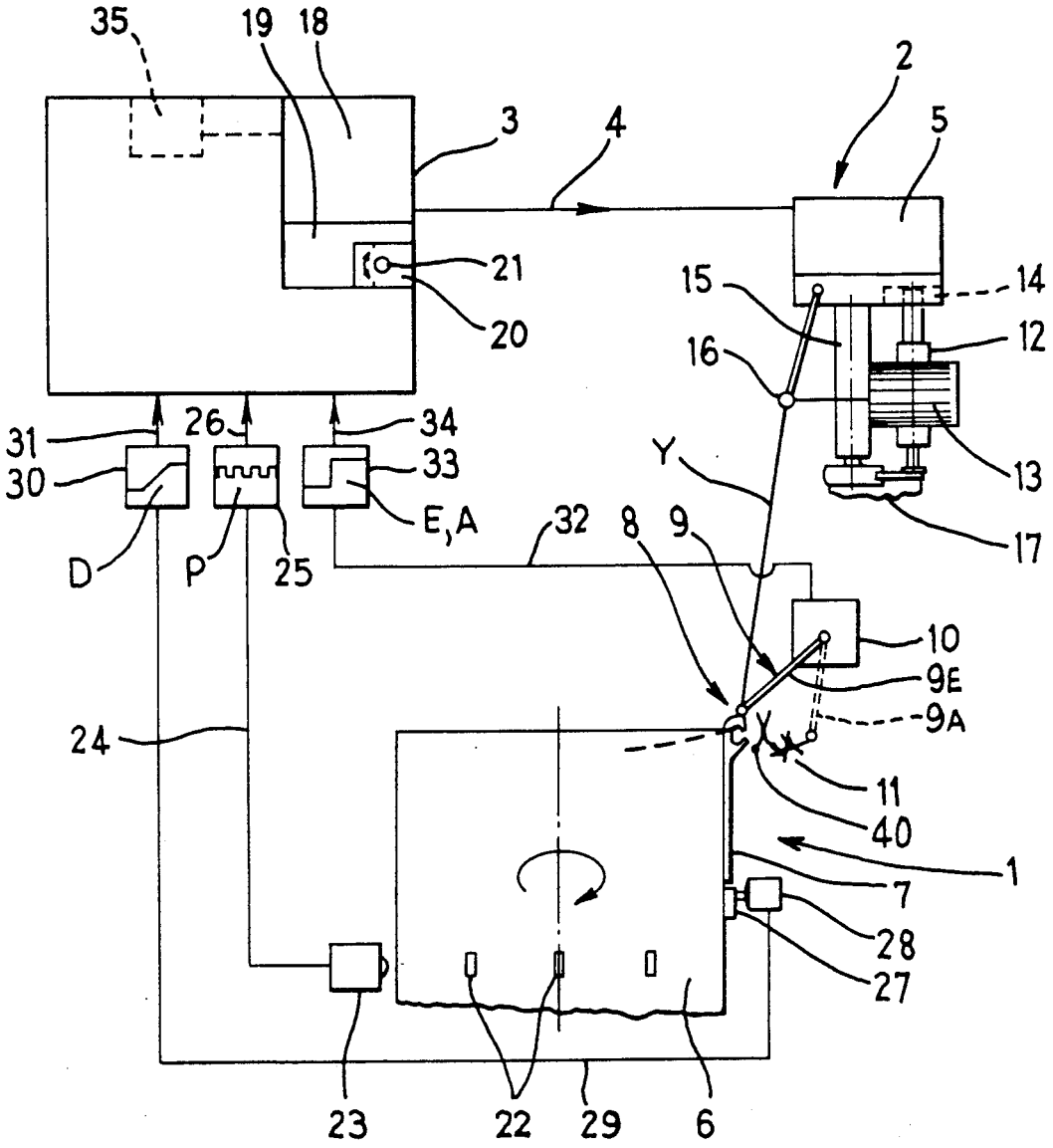
FIG. 1 shows a diagrammatical illustration, partially in the form of a block diagram, of components of a circular knitting machine equipped with a positive yarn feeder apparatus and an electronic control unit.

A circular knitting machine 1 shown in FIG. 1, particularly a stocking knitting machine, is equipped with a positive yarn feeder apparatus 2 controlled by an electronic control unit 3. To this purpose there exists a signal-transmitting connection 4 between control unit 3 and a drive motor 5 of the yarn feeder apparatus 2. Diagrammatically indicated as a component of circular knitting machine 1 is an upper portion of a knitting cylinder 6 having a plurality of needles 7 mounted for vertical displacement about its periphery. A knitting system 8 of the circular knitting machine 1 comprises a yarn guide 9 connected to diagrammatically indicated drive means 10 for reciprocating movement between a lead-in position (indicated with a solid line at 9E) and a take-out position (indicated with dotted line at 9A). Knitting system 8 is further provided with a cut-off device 40 and a yarn clamp 11 for retaining the free end of a cut-off yarn Y. In addition, a suction pipe (not shown) may be provided at this location for ensuring the proper orientation of the end of yarn Y in the conventional manner.

In the embodiment shown, positive yarn feeder apparatus 2 comprises a rotatably mounted spool 12 carrying a supply 13 of yarn Y. Yarn Y is an elastic thread, for instance an elastomer or rubber thread, bare or textile-covered.

Spool 12 is supported in a drive-transmitting portion 14 below drive motor 5. Drive-transmitting portion 14 further carries a drive-transmitting roller 15 mounted with its axis parallel to that of spool 12 and driven by drive motor 5. A spring 17 acts to bias spool, 12 into engagement with drive-transmitting roller 15, so that the rotation of the latter causes yarn Y to be unwound. After leaving spool 12, yarn Y extends partially around drive-transmitting roller 15 and then passes through a yarn eyelet 16 on its way to knitting system 8.

Drive motor 5 is preferably a step motor. Drive-transmitting roller 15 may also be replaced by a squeeze roller pair (DE-A-3002311) operable to unwind yarn Y. It is also possible to employ a variable speed electric drive motor (DC motor) (GB-A-2158973). These two prior publications are incorporated herein by reference to emphasize that the method according to the invention is applicable to various types of positive yarn feeder apparatus.

Electronic control unit 3 of yarn feeder apparatus 2 contains a speed control circuit 18 for generating drive control signals and applying them to drive motor 5 (step motor) to thereby control its operating speed. Connected to speed control circuit 18 is a delay circuit 19 provided with selector means 20 including a rotary knob 21. The purpose of delay circuit 19 will become evident as the description proceeds.

Circular knitting machine 1, which may be operable in accordance with conventional operating and control principles, has its knitting cylinder 6 provided with position markers 22 (lugs or reflector strips) for cooperation with a sensor 23 (proximity sensor, optoelectronic sensor or the like) connected to a signal-generating circuit component 25 via a conductor 24. Signal-generating circuit component 25 acts to generate a position signal sequence P and to transmit it to control unit 3 via a conductor 26. The knitting stroke of needles 7 is controlled by cams 27 and is monitored by a further sensor 28 connected to a signal-generating component 30 via a conductor 29. Component 30 generates a signal D which is representative of the yarn demand and transmitted to control unit 3 through a conductor 31. The operating device 10 of yarn guide 9 may contain an ON-OFF switch (not shown) connected to signal-generating component 33 through a conductor 32 and operable in response to yarn Y being led in and taken out. The operating device 10 and component 33 generate respective lead-in and take-out signals to be transmitted to control unit 3 through a conductor 34.

Indicated by dotted lines in control unit 3 is a timing signal pulse generator 35, such as a clock circuit which may also be connected in signal-transmitting relation to speed control circuit 18 or delay circuit 19, respectively.

When elastic yarn Y is being knitted, yarn guide 9 is in its lead-in position 9E so that needles 7 are able to engage yarn Y. The lead-in signal E has activated speed control circuit 18 of control unit 3. With the aid of position signal sequence P, control unit 3 supplies drive motor 5 with speed control signals corresponding to the yarn demand. During the thus accomplished positive feed of the yarn, it is brought to a longitudinal tension as required for the shape of the knitted product. Yarn Y is thus knitted until operating device 10 acts in response to the pattern being knit to rotate yarn guide 9 to its take-out position 9A for disengaging yarn Y from needles 7. At this time yarn Y is inserted into yarn clamp 11 and severed by cut-off device 40. This take-out operation causes signal-generator 33 to generate a take-out signal A to be transmitted to delay circuit 19 and to control unit 3. On appearance of take-out signal A, control unit 3 acts to carry out conventional control routines not immediately related to the subject matter of the invention. At this time drive motor 5 is not immediately stopped, but continues to operate under the direction of control unit 3 for feeding further yarn Y until the length of yarn between yarn feeder apparatus 2 and knitting system 8 is at least substantially relaxed.

Figure 2:
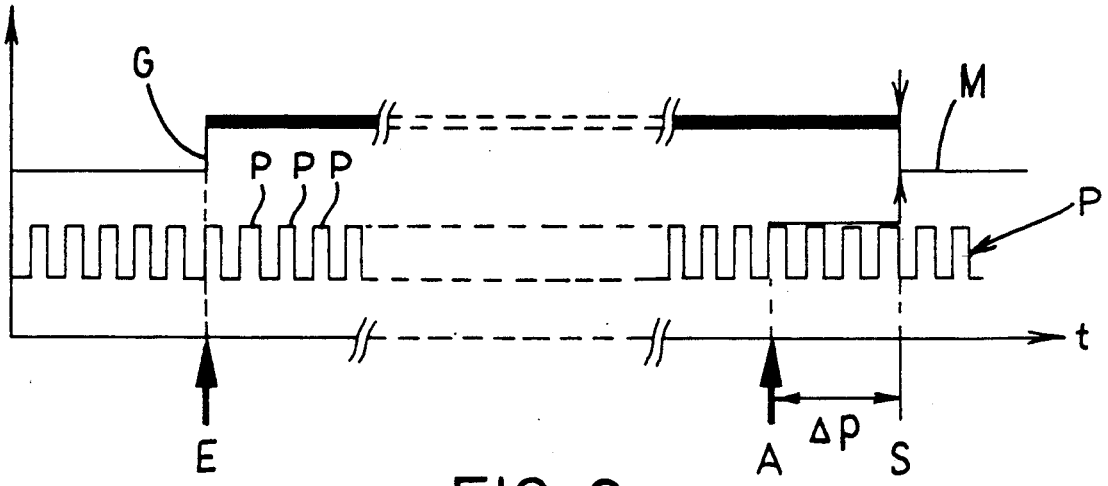
FIG. 2 shows a diagram of a signal sequence in a first embodiment.

In one embodiment of the method (FIG. 2), use is made for this operating phase of the position signals p of position signal sequence P. To this purpose, selector means 20 is actuated to adjust delay circuit 19 to a determined number of position signals S, so that a stop signal P for drive motor 5 is generated only after the number of position signals received coincides with the selected number of Δ position signals, designated by Δp in FIG. 2. This number of position signals is selected by Δp means of rotary knob 21 in conformity with the characteristics of the elastic yarn Y and/or the distance between yarn feeder apparatus 2 and knitting system 8. As shown in FIG. 2, position signal sequence P is not affected by the appearance of lead-in signal E. At this time control unit 3 generates a start signal G for drive motor 5, whereupon the operating speed of drive motor 5 is controlled by means of the already mentioned speed control signals. In FIG. 2 the speed control signals are indicated by a straight line. In practice they are in the form of a modulated pulse sequence. On appearance of take-out signal A the speed control signal M remains substantially unchanged, while delay circuit 19 is activated to count position signals p until their counted number coincides with the preselected number as designated by Δp. At this time the stop signal S for drive motor 5 is generated, so that the latter is stopped. The yarn feeding operation is thus continued while the selected number Δp of position signals p is being counted to thereby substantially relax the tension of yarn Y. As position signal sequence P subsequently continues to be generated, drive motor 5 remains stopped until the next lead-in signal is generated as required by the knitting pattern.

Since the relaxation of yarn Y has the purpose of ensuring safe retention of yarn Y in yarn clamp 11, the number Δp of position pulses may be selected so that the yarn feeding operation terminates with the clamping of yarn Y. It is also possible, however, to continue the yarn feeding operation for a certain period after yarn Y has been clamped to thereby prevent yarn Y from being slowly pulled out of clamp 11. It is further possible to operate drive motor 5 at a higher speed than previously after the appearance of take-out signal A, so that yarn Y is fully relaxed before it is clamped. On the other hand drive motor 5 may be operated at a lower speed than previously after apperarance of take-out signal A, so that the relaxation of the yarn is accomplished in a controlled manner by continuing the yarn feed operation after the yarn has been clamped.

Instead of employing position signal sequence P for controlling the continued yarn feeding operation, it is also possible to control the continued yarn feeding operation on a time basis, as explained with reference to FIG. 3 in connection with signal generator or clock circuit 35 shown in FIG. 1. In this case delay circuit 19 is adjustable to a determined space of time Δt to expire between the appearance of take-out signal A and the generation of stop signal S for relaxing the tension of yarn Y.

Figure 3:
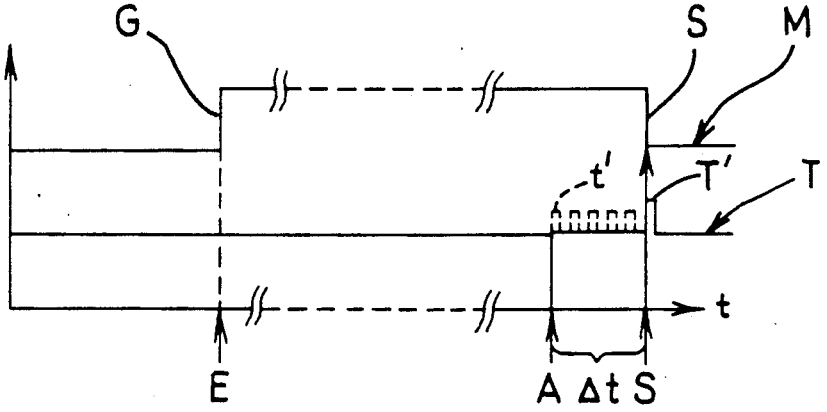
FIG. 3 shows a diagram of a signal sequence in a further embodiment.

As shown in FIG. 3, the appearance of lead-in signal E causes start signal G for drive motor 5 to be generated. The appearance of take-out signal A marks the beginning of a selected interval of time Δt, the end of which may be marked by a time signal T' of a time signal sequence T. As soon as time signal T' appears, control unit 3 acts to generate stop signal S which is applied to drive motor 5 for stopping its operation. When employing signal generator or clock circuit 35, the selected interval of time Δt may be represented by a selected number of time signals t'. During the thus selected interval of time Δt, drive motor 5 may be controlled to operate at the same speed as before the appearance of take-out signal A, or selectively at a higher or a lower speed.

In both embodiments of the method, the take-out signal A or the stop signal S may preferably be used for resetting delay circuit 19, so that during the next knitting cycle using yarn Y the delay circuit starts anew to count the preselected number Δp of position signals p or to measure the selected interval of time Δt.

Since the method described requires circular knitting machine 1 to be only provided with means for the generation of position, yarn demand, lead-in and take-out signals, without any modification of its mechanical construction, the described method is particularly suitable for re-equipping circular knitting machines already in use or conceived for other yarn feeding principles to thereby permit elastic yarns to be processed. It goes without saying that a plurality of yarn feeder devices 2 for elastic yarns may be disposed about the periphery of knitting cylinder 6, between or in place of other yarn feeder devices for normal yarns.

I claim:

1. In a method for positively feeding an elastic yarn to a knitting system of a circular knitting machine including an electronic control unit for controlling the positive feeding of the elastic yarn from a positive yarn feeder apparatus to said knitting system, said control unit being normally operable in response to the lead-in and take-out of the elastic yarn by means of a yarn guide of said knitting system to generate a start signal and a stop signal, respectively, for an electric drive motor of said positive yarn feeder apparatus, said drive motor being responsive to said start signal for causing said positive yarn feeder apparatus to positively feed the elastic yarn to the knitting system until said stop signal is generated, said control unit being supplied with position signals derived from the operation of said circular knitting machine for controlling said drive motor by means of speed control signals corresponding to the yarn demand during the interval between said start signal and said stop signal, the improvement wherein said control unit delays the generation of said stop signal for a preselected space of time after receiving a yarn take-out signal so that said drive motor continues to effect said positive yarn feeding operation for the duration of said preselected space of time, and wherein said control unit thereafter generates said stop signal for said drive motor only after said preselected space of time has expired, said space of time being selected in accordance with the yarn characteristics and/or the yarn length between said yarn feeder apparatus and said knitting system so that said elastic yarn between said positive feeder apparatus and said knitting system is substantially relaxed when said drive motor is stopped.

2. A method according to claim 1 wherein, from the appearance of said take-out signal, said control unit operates to count said position signals and to compare their number to a preselected number of position signals, said stop signal being applied to said drive motor only when the counted number of position signals coincides with the preselected number of position signals, and said preselected number of position signals being selected in accordance with the yarn characteristics and/or the yarn length between said positive yarn feeder apparatus and said knitting system.

3. A method according to claim 2, wherein, on appearance of said take-out signal, said control unit acts to increase or reduce the operating speed of said drive motor relative to its operating speed prior to the appearance of said take-out signal.

4. A method according to claim 1, wherein said preselected space of time is determined by counting signals of a time signal sequence.

5. A method according to claim 1, wherein, after appearance of said take-out signal, said control unit is responsive to the appearance of an end signal to generate said stop signal and transmit it to said drive motor, said end signal representing the termination of said preselected space of time.

6. In a circular knitting machine comprising at least one positive yarn feeder apparatus for feeding an elastic yarn to a knitting system, an electronic control unit for said positive yarn feeder apparatus operatively connected to an electric drive motor of said yarn feeder apparatus, said electric drive motor being operative to cause said yarn feeding apparatus to positively feed said elastic yarn to the knitting system, at least one signal generator connected to said control unit and associated with a yarn guide for generating a yarn leadin signal and a yarn take-out signal in response to said yarn being led into or taken out of said knitting system, respectively, said control unit including means responsive to said yarn lead-in signal and said yarn take-out signal for normally respectively generating a start signal and a stop signal which respectively actuate and de-actuate said drive motor, a position signal generator connected to said control unit for generating regular position signals in response to the operation of said circular knitting machine, and a speed control section in said control unit for controlling the operating speed of said drive motor in response at least to said position signals, the improvement wherein the connection for transmitting said start and stop signals between said control unit and said drive motor includes an adjustable delay circuit means activated by said yarn take-out signal for adjustably delaying the generation of said stop signal and the corresponding de-actuation of said drive motor for a selected space of time after the generation of said yarn take-out signal, said delay circuit means being operable to generate said stop signal and to apply it to said drive motor as soon as said preselected space of time has expired.

7. A circular knitting machine according to claim 6, wherein said delay circuit means includes selector means for selecting the length of said space of time.

8. A circular knitting machine according to claim 6, wherein said control unit includes a time signal pulse generator or a clock circuit adapted to be reset by said take-out signal.

9. A circular knitting machine according to claim 6, wherein said speed control section of said control unit is operable to generate variable speed control signals for said drive motor preferably a step motor or another variable-speed electric motor, to thereby adjust the operating speed of said drive motor in response to the appearance of said take-out signal to a value different from that of the operating speed prior to the appearance of said take-out signal.

10. A machine according to claim 6, wherein said delay circuit means includes means activated by said take-out signal for permitting said stop signal to be applied to said motor only after the occurrence of a preselected number of said position signals subsequent to said take-out signal.

11. A circular knitting machine according to claim 10, wherein said delay circuit comprises a position signal counter circuit, preferably a driver circuit for said take-out signal or said stop signal (S) controlled by said position signals.

12. A machine according to claim 10, wherein said delay circuit means includes selector means for selecting said preselected number of position signals.

13. A machine according to claim 10, wherein said speed control section of said control unit is operable to generate variable speed control signals for said drive motor preferably a step motor or another variable-speed electric motor, to thereby adjust the operating speed of said drive motor in response to the appearance of said take-out signal to a value different from that of the operating speed prior to the appearance of said take-out signal.

* * * * *